US007621495B2

(12) United States Patent
Young

(10) Patent No.: US 7,621,495 B2
(45) Date of Patent: Nov. 24, 2009

(54) CHEMICAL REACTOR CLAMP

(76) Inventor: Li Young, 553 Stony Brook Dr., Bridgewater, NJ (US) 08807

( * ) Notice: Subject to any disclaimer, the term of this patent is extended or adjusted under 35 U.S.C. 154(b) by 450 days.

(21) Appl. No.: 11/058,990

(22) Filed: Feb. 16, 2005

(65) Prior Publication Data

US 2006/0180727 A1 Aug. 17, 2006

(51) Int. Cl.
*A47G 1/10* (2006.01)

(52) U.S. Cl. ..... 248/316.1; 248/316.7; 24/326

(58) Field of Classification Search ..... 248/113, 248/121, 124.2, 313, 316.1, 316.7, 540, 229.26, 248/229.16, 228.7, 230.7, 231.81; 24/326, 24/455

See application file for complete search history.

(56) References Cited

U.S. PATENT DOCUMENTS

| | | | | | |
|---|---|---|---|---|---|
| 499,933 | A | * | 6/1893 | Phillips | 280/176 |
| 505,060 | A | * | 9/1893 | Mills | 248/124.2 |
| 661,677 | A | * | 11/1900 | Taylor | 211/22 |
| 1,197,549 | A | * | 9/1916 | Russell | 70/17 |
| 1,394,788 | A | * | 10/1921 | Potstada | 248/229.23 |
| 1,519,067 | A | * | 12/1924 | Smith | 29/256 |
| 2,212,156 | A | * | 8/1940 | Erdley | 248/229.13 |
| 2,269,790 | A | * | 1/1942 | Sherrill | 24/132 R |
| 2,499,945 | A | * | 3/1950 | Burrell | 248/124.2 |
| 2,915,096 | A | * | 12/1959 | Mooney | 269/157 |
| 2,989,337 | A | * | 6/1961 | Pispisa | 294/106 |
| 3,221,892 | A | * | 12/1965 | Morcheles et al. | 211/48 |
| 3,222,020 | A | | 12/1965 | Rea | |
| 3,365,164 | A | * | 1/1968 | Engels | 248/443 |
| 3,893,813 | A | * | 7/1975 | Johnson | 422/104 |
| 3,905,570 | A | | 9/1975 | Nieuwveld | |
| 4,211,380 | A | * | 7/1980 | Lillegard et al. | 248/229.15 |
| 4,787,591 | A | | 11/1988 | Villacorta | |
| 5,624,638 | A | | 4/1997 | Negrotti | |
| 6,585,207 | B2 | | 7/2003 | Ibbitson et al. | |
| 7,076,910 | B1 | * | 7/2006 | Xifra | 43/4 |
| 7,178,777 | B1 | * | 2/2007 | Banker | 248/316.7 |
| 2005/0131394 | A1 | * | 6/2005 | Bjork et al. | 606/1 |

* cited by examiner

*Primary Examiner*—Kimberly T Wood
(74) *Attorney, Agent, or Firm*—Kenneth P. Glynn, Esq.

(57) ABSTRACT

A chemical reactor clamp for supporting a glassware or equivalent chemical reactor having a neck includes: (a) a central housing; (b) a spring-biased yoke connected to the central housing and extending outwardly therefrom for a attachment to the reactor neck; (c) a female socket on the central housing and adapted to receive a clamp rod; and, (d) a clamp rod locking mechanism on the central housing at the female socket. There is also a combination of the clamp with the rod, as well as a system with the clamp, rod and rod support unit, as well as a system with these components and a second rod (vertical rod) and a vertical rod base, to provide multiple degrees of freedom of movement for the clamp.

14 Claims, 23 Drawing Sheets

CHEMICAL REACTOR CLAMP

BACKGROUND OF THE INVENTION

1. Field of the Invention

The present invention relates to chemical reactor clamps that are used in bench-type research and development, chemistry, physics, earth sciences, engineering and process industries, pharmaceutical, biochemical and biological and other scientific endeavors. The present invention clamps are diverse and secure and provide for insertion, locking, unlocking and removal of clamp rods that act as clamp supports, as well as stabilizers for reactors in the clamps. The rod also becomes the pivot point for rotation of the clamp (and the reactor it is holding), due to the relationship between the clamp and the clamp rod. Further, the a rod and clamp may be connected to rod support unit to create a present invention system, and the system may be enhanced to provide multiple degrees of freedom of movement of the reactor clamp and any reactor that it may hold.

2. Information Disclosure Statement

The following patents show some typical and unusual state of the art clamps for glassware:

U.S. Pat. No. 3,222,020 issued to Herman K. Rea describes an apparatus for holding a nursing bottle comprising a knock down supporting frame including (a) a pair of detachable L-shaped base members, each having a socket at the end of one of the legs, (b) a pair of L-shaped bridge members, the ends of said bridge members being tapered, one end of each bridge member being received within a cooperating socket of a base member, (c) a bridge bushing having cavities for receiving the other ends of said bridge members, said bushing being rotatable with respect to said bridge members, (d) an adjustable supporting arm slidably and rotatably mounted in said busing and mounted transversely of said bridge members, and (e) a flexible bottle supporting clamp mounted adjacent one end of said supporting arm.

U.S. Pat. No. 3,905,570 issued to Aril J. Nienwveld describes a resilient fastening device mountable simply by being thrust into a hole of appropriate size, and preferably made as a unitary molding of a synthetic resin such as a polyamide resin, comprises a head and a plurality of substantially parallel resilient legs spaced apart on and projecting for the head. Each leg has outward protrusions preferably formed by leg segments of approximately semi-frusto-conical shape, the outer edges of which normally extend beyond the hole diameter but can be fitted into the hole when the legs are pressed together as by being forced into the hole, whereupon the protrusions press outwardly against the wall of the hole even if it is irregular in diameter. The head of the device may comprise an article-retaining portion such as a resilient clip for a tool or like article, or a split circular clamp for a wire, cable, pipe, or like object. A dual purpose form of the device has a backward section of each leg composed of several protrusion forming segments connected through a narrower intermediate segment with a forward section composed of a first protrusion forming segment connected with the head through a neck segment. Upon removal of the backward leg sections by severance of the intermediate segments, the remnant device is readily mountable in a shallow hole by forcing the first set of protrusions through the hole.

U.S. Pat. No. 4,787,591 issued to Gilberto M. Villacorta describes a simple inexpensive clamp comprised of a flexible "C"-shaped, fixed-diameter clamping means, a rigid support member, and a "C"-shaped anchoring means whose overall design and construction allows the user to fasten, secure, and release objects quickly and easily with a minimum level of dexterity.

U.S. Pat. No. 5,624,638 issued to David F. Negrotti describes a personal, miniaturized, multipurpose test kit for performing a plurality of chemical tests and procedures, which include interchangeable multifunctional elements connecting adapted for arrangement of multiple test configurations including a parable container, at least one component body element adapted for providing a reactor reservoir, at least one access cap, a coupling device for coupling multiple components, fasteners typically pop in-pop out fastening devices all constructed of impact proof, damage resistant material, adapted to perform experiments using small amounts of solvents and samples while preserving the accuracy precision and manual control, wherein a plurality of test modules may be rapidly selectively set up to conduct a plurality of procedures and tests including pressure-volume, titration, precipitation, density, electro-chemistry, (galvanic or voltaic), chromatography, viscosity, diffusion wherein liquid or gas, molecular weights, melting points, boiling points, thermodynamics, solid gas and/or liquid reactions in static or flowing streams. Further including the method for connecting the elements of the test kit to provide for arrangement of multiple test configurations. Included in the test kit is a solvent dispenser, a minitrator dispensing element with a pop-in pop-out fastening technology, and array of components employing a unique o-ring seat and seal apparatus, employed in cooperation with reactor caps and tube joints.

U.S. Pat. No. 6,585,207 issued to Scott Alan Ibbitson et al. describes an adjustable clamp holder having multiple securing mechanisms for each attachment structure of the clamp body is disclosed. The clamp has utility in fastening together support rods and supporting an apparatus or laboratory equipment. The clamp holder obviates the limited securing capabilities and safety concerns associated with previously known clamp devices.

Notwithstanding the prior art, the present invention is neither taught nor rendered obvious thereby.

SUMMARY OF THE INVENTION

The present invention is a chemical reactor clamp for supporting a glassware or equivalent chemical reactor having a neck. The present invention clamp includes: (a) a central housing; (b) a spring-biased yoke connected to the central housing and extending outwardly therefrom for a attachment to the reactor neck; (c) a female socket on the central housing and adapted to receive a clamp rod; and, (d) a clamp rod locking mechanism on the central housing at the female socket.

In some embodiments, the clamp rod locking mechanism includes a wide socket slot located in the female socket to receive a rod with a wide end (being wider than the typical thickness of the rod), and further includes a sliding cover to lock a rod into the slot. In some preferred embodiments, the sliding cover has an unlock position and a lock position, and the sliding cover is biased to its lock position by a biasing means connected to the cover and to the central housing. The biasing means may be any means that will push the cover to its locked position, such as a leaf spring, a coil, a living plastic separate or molded in place spring.

In some preferred embodiments of the present invention chemical reactor clamp, the spring biased yoke is made of a resilient material and acts as its own spring. Preferably, the spring biased yoke is a resilient metal strip having an open end and opposing arc sections for clamping to opposing sections of a chemical reactor neck.

The present invention is also directed to a combination of chemical reactor clamp and rod for supporting a glassware reactor or equivalent chemical reactor having a neck. This combination includes the clamp described above, and a rod for connection to the clamp, the rod being elongated with a central portion, a first end and an opposing second end, wherein the first end is wider than the central portion and is adapted to fit into the female socket. In some embodiments, the rod has a central portion with a predetermined thickness and the first end has a thickness greater than the central portion predetermined thickness. The rod could have any cross-sectional shape, but is preferably cylindrical and the central portion has a predetermined diameter and the first end has a diameter greater than the central portion diameter.

In another embodiment, the present invention is a chemical reactor clamp system for supporting a glassware reactor or equivalent chemical reactor having a neck. It includes the clamp described above, the rod described above, and a rod support unit, including a support housing and a rod keyhole adapted to receive the second end of the rod. The system may be further enhanced with additional components to provide multiple degrees of freedom of movement of the clamp and any reactor that it may hold, by proving a vertical secondary support rod and a secondary support base. This will enable a user to move a present invention clamp with a reactor up and down, and in and out, as well as to swing them along a horizontal arc and to rotate them about the horizontal rod to achieve any desired position and angle from the vertical axis.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
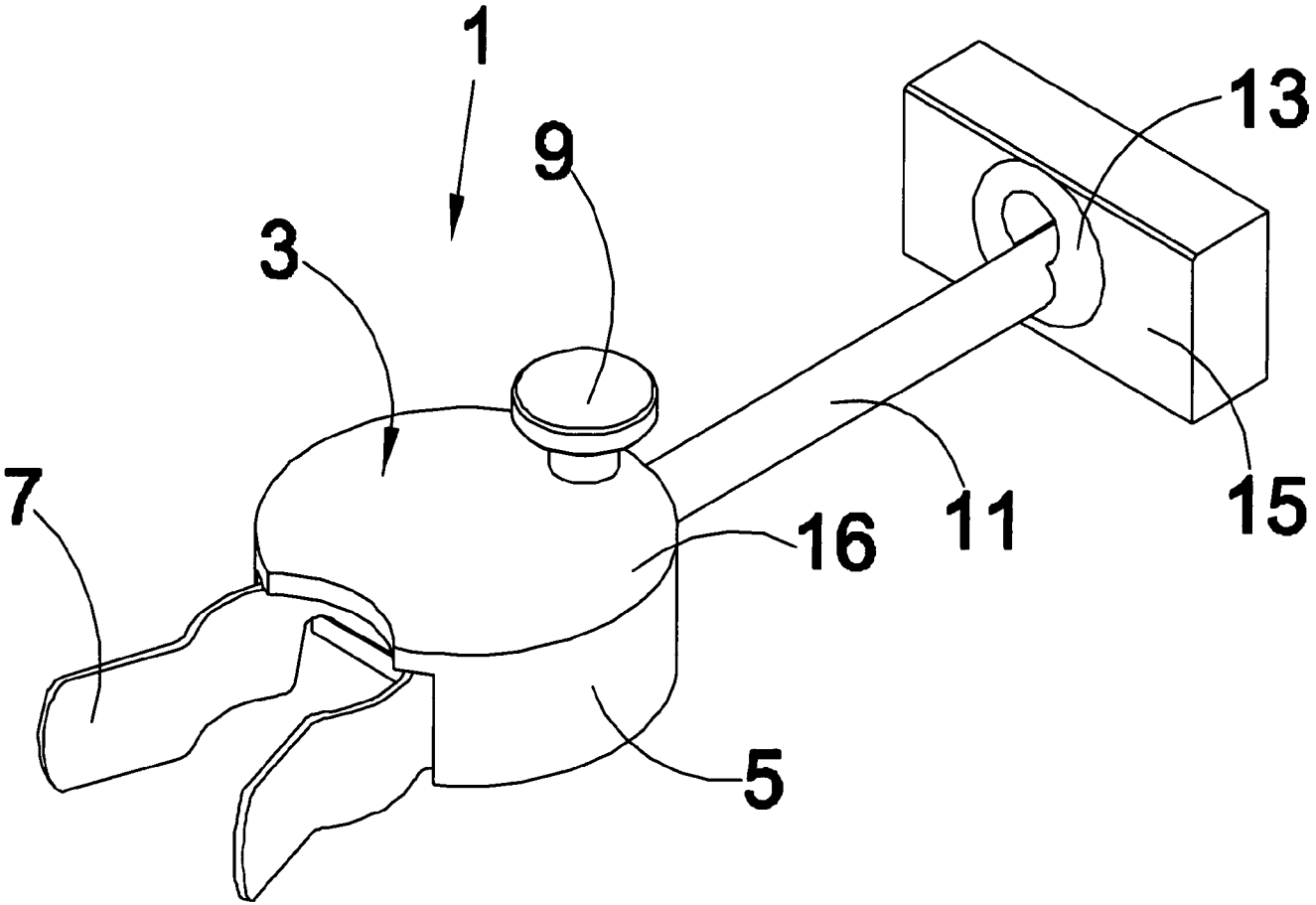
FIG. 1 shows a perspective view of one embodiment of a present invention chemical reactor clamp and FIG. 2 shows the present invention clamp of FIG. 1 in use with a chemical reactor flask.
Figure 2:
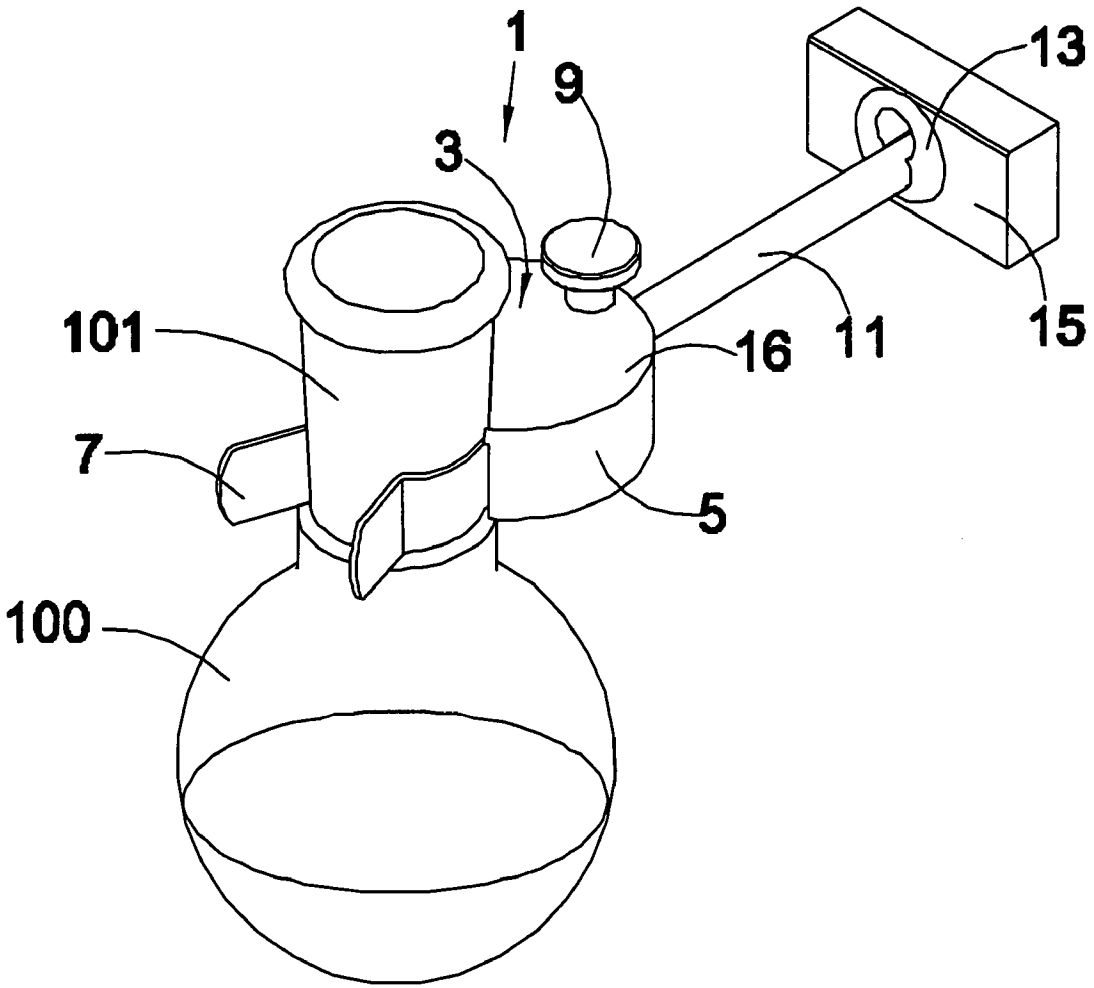

FIG. 1 shows a perspective view of one embodiment of a present invention chemical reactor clamp 1 and FIG. 2 shows the present invention clamp 1 in use with a chemical reactor flask. Identical parts are identically numbered for these Figures, as well as other Figures below that show or include all or part of present invention chemical reactor clamp 1. Restatement of the description and definition of every such part for every Figure is therefore unnecessary.

Referring to FIGS. 1 and 2, clamp 1 includes a central housing 3, with a circular sidewall 5 and a top 16. Central housing 3 has a spring biased yoke 7 that extends outwardly from the central housing 3. The yoke has opposing sides that in this embodiment, act as their own springs, and are spring biased so as to rest in the position shown in FIG. 1. When a reactor (beaker, flask, vessel or equivalent) is pushed into the yoke 7, it spreads and then closes back onto the neck 101 of the reactor flask 100 to hold it in place, as shown in FIG. 2. Rod 11 holds the central housing in place, and it in turn has been inserted into keyhole rod support unit 13, built into a stand, device, lab fixtures, bench or wall 15. Locking screw 9 locks and unlocks to enable central housing 3 and any reactor it holds to be rotated about the horizontal axis of rod 11

Figure 3:
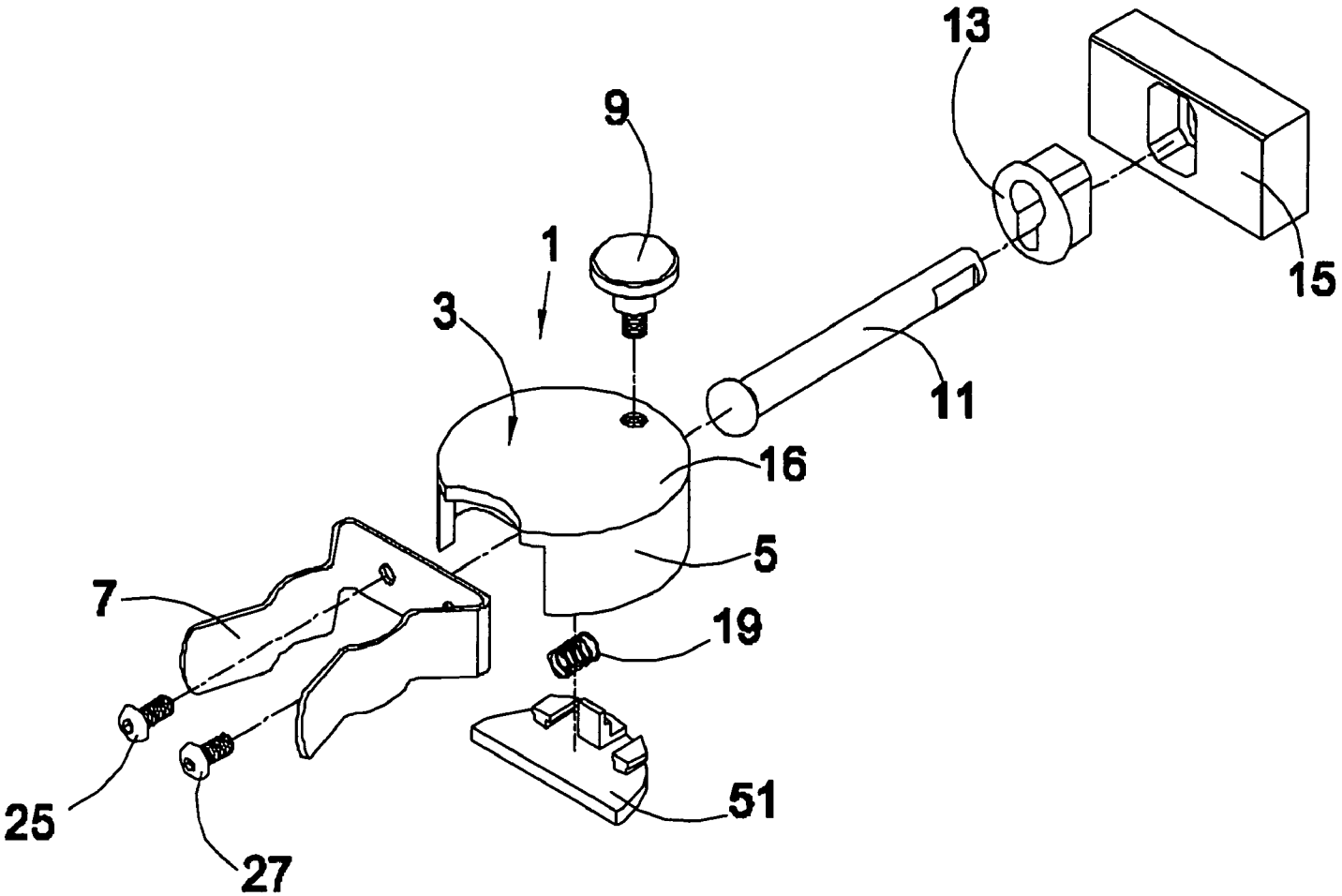
FIG. 3 shows a perspective exploded view of the present invention chemical reactor clamp shown above.

FIG. 3 shows a perspective exploded view of the present invention chemical reactor clamp 1, shown in FIGS. 1 and 2 above. The main housing, also called the central housing 3, is threaded to receive locking screw 9, is recessed in its front to receive, fasten and retain the degree of stress on yoke 7. Screws 25 and 27 fasten the yoke 7 to the housing 3. There is a female socket on the bottom of the housing 3 (shown and described in detail in the Figures below) and a clamp rod locking mechanism 51 with its biasing spring 19. Rod 11 has a narrower flat that locks into rod support unit 13.

Figure 4:
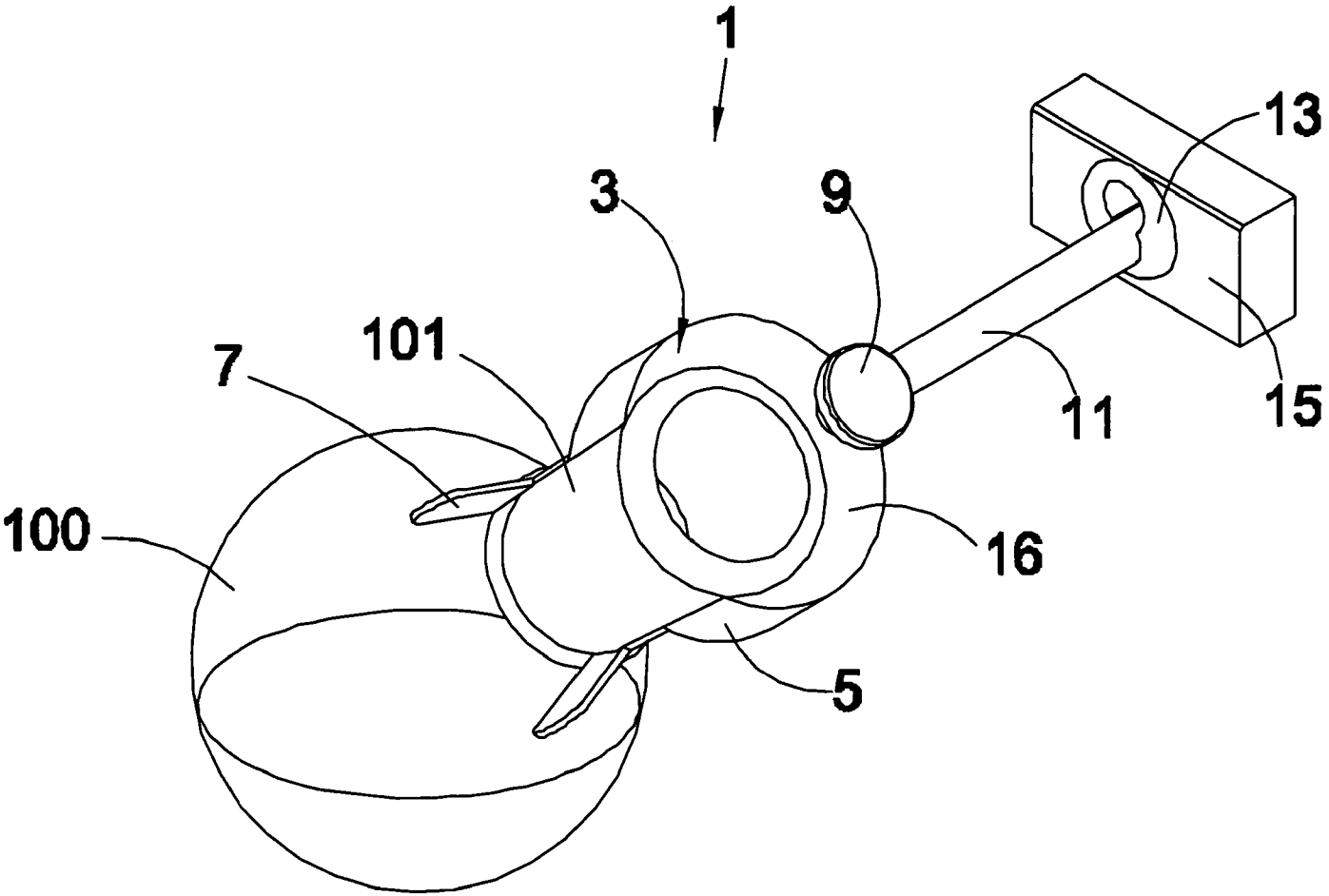
FIG. 4 shows the same representation as in FIG. 2 but with the flask positioned at a 45° angle.

FIG. 4 shows the same representation as in FIG. 2 but with the reactor flask 100 positioned at desired angle from vertical. This is accomplished by unscrewing locking screw 9, rotating the housing 3 about rod 11 about its horizontal axis to position the housing and reactor flask 100 at the desired angle, and the relocking in the new position by tightening locking screw 9.

Figure 5:
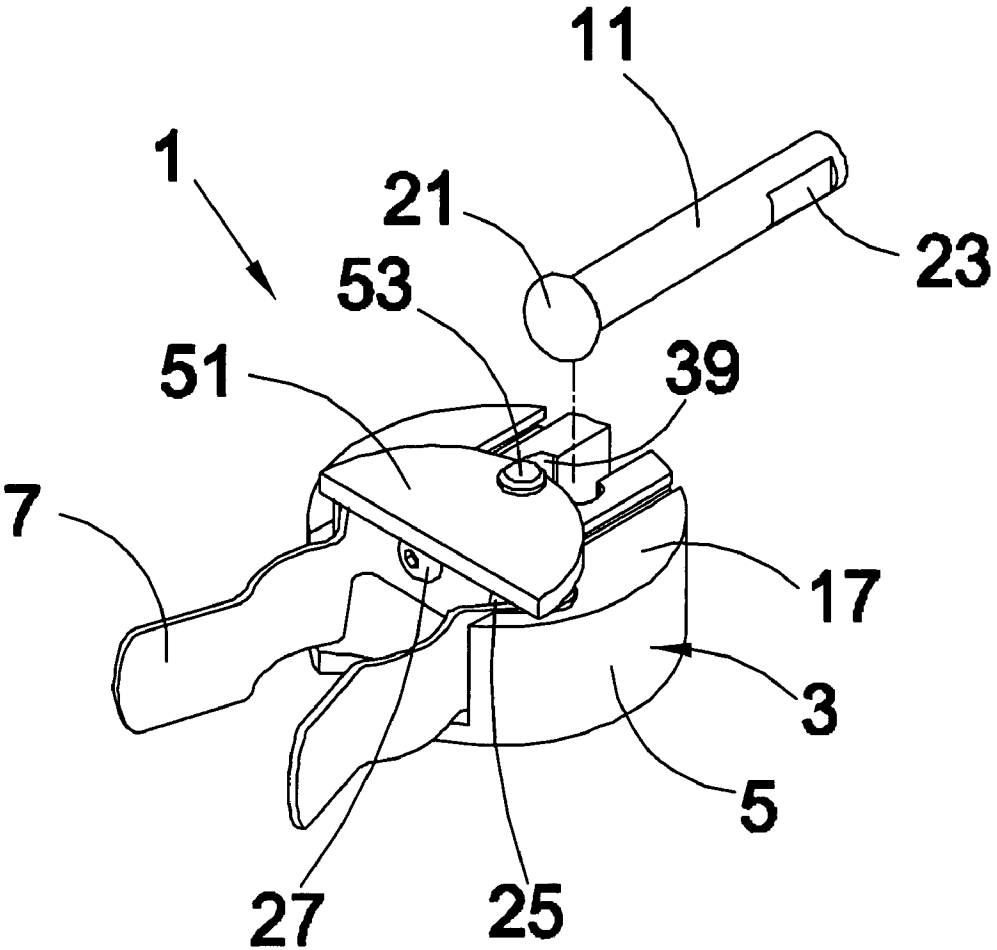
FIG. 5 shows a bottom perspective view of the present invention clamp shown above.

FIG. 5 shows a bottom perspective view of the present invention clamp 1 shown above. In this view, the female socket 39 is shown, and is sized to receive rod disk end 21. End 21 has a larger cross section than rod 11's main body. At the opposite end, there is a narrower rod section 23, having a smaller cross section than rod 11's main body, for fittage in the keyhole of the rod support unit described above and below. Yoke 7 is in the recess of housing Also shown in this Figure is clamp rod locking mechanism 51, with its slide button 53, in its stressed position and pulled back from female socket 39 to receive rod 11's disk end 21.

Figure 6:
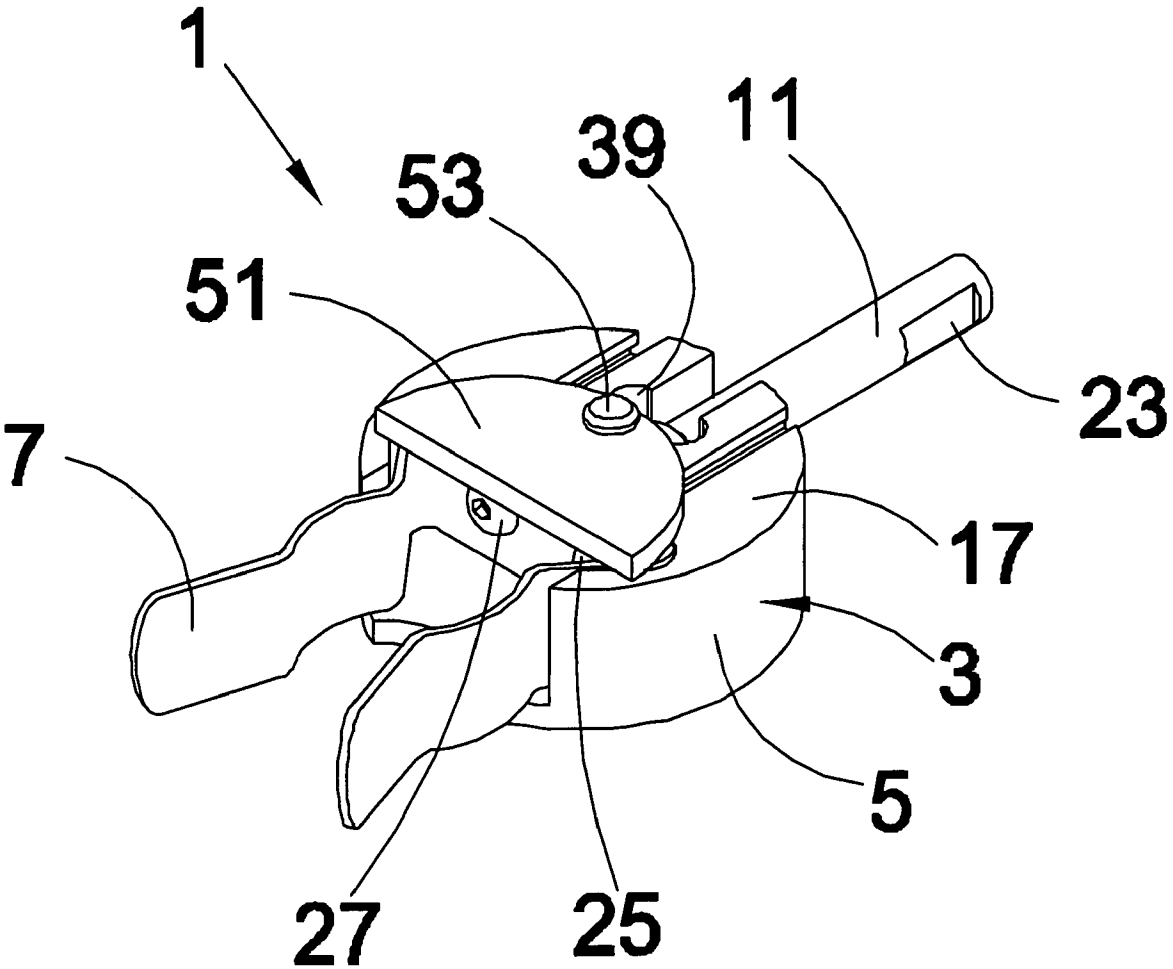
FIG. 6 shows a bottom perspective view as shown in FIG. 5 but with the rod inserted.
Figure 7:
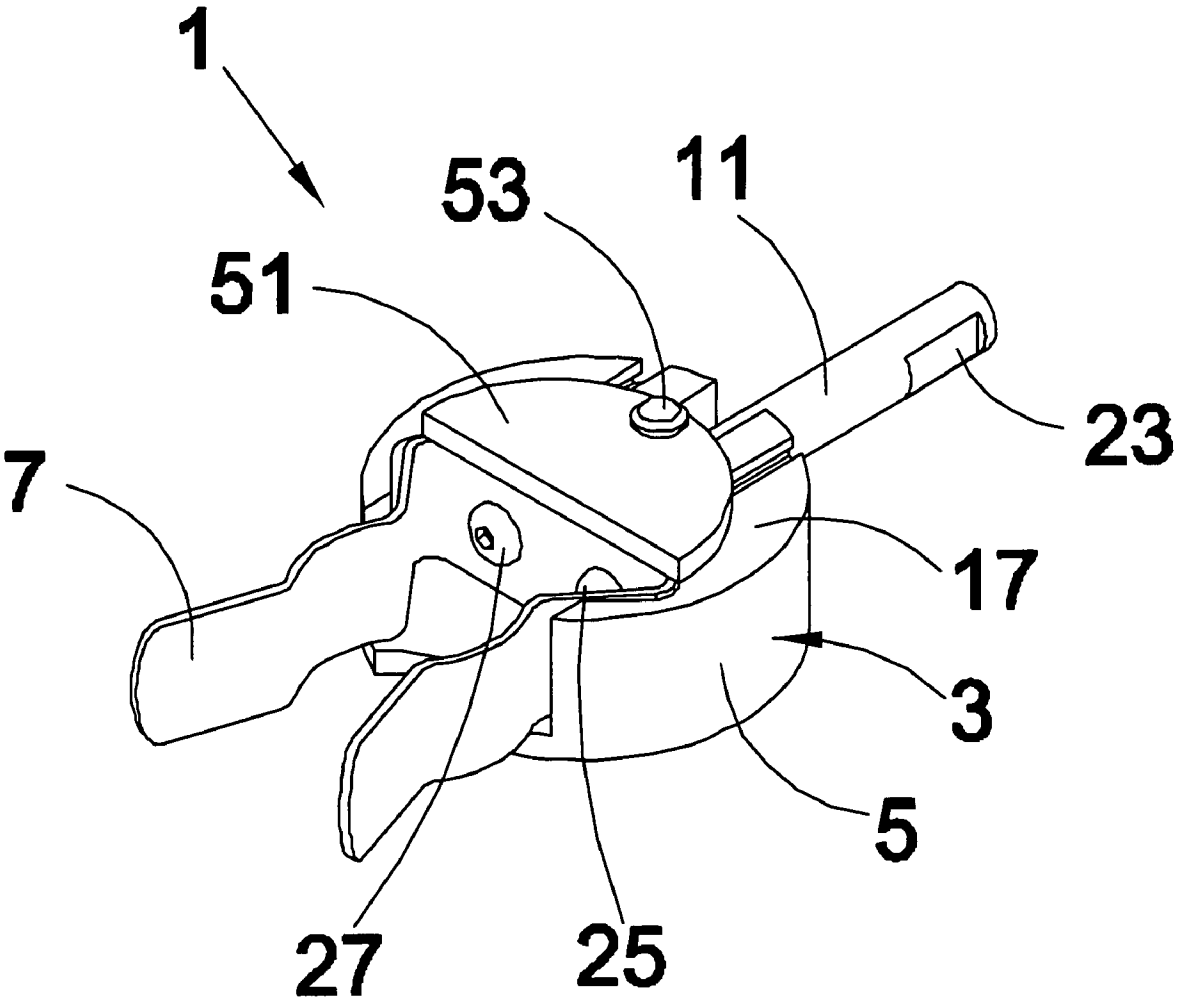
FIG. 7 shows the same bottom perspective view as shown in FIG. 6 but with the locking mechanism in the locked position.
Figure 8:
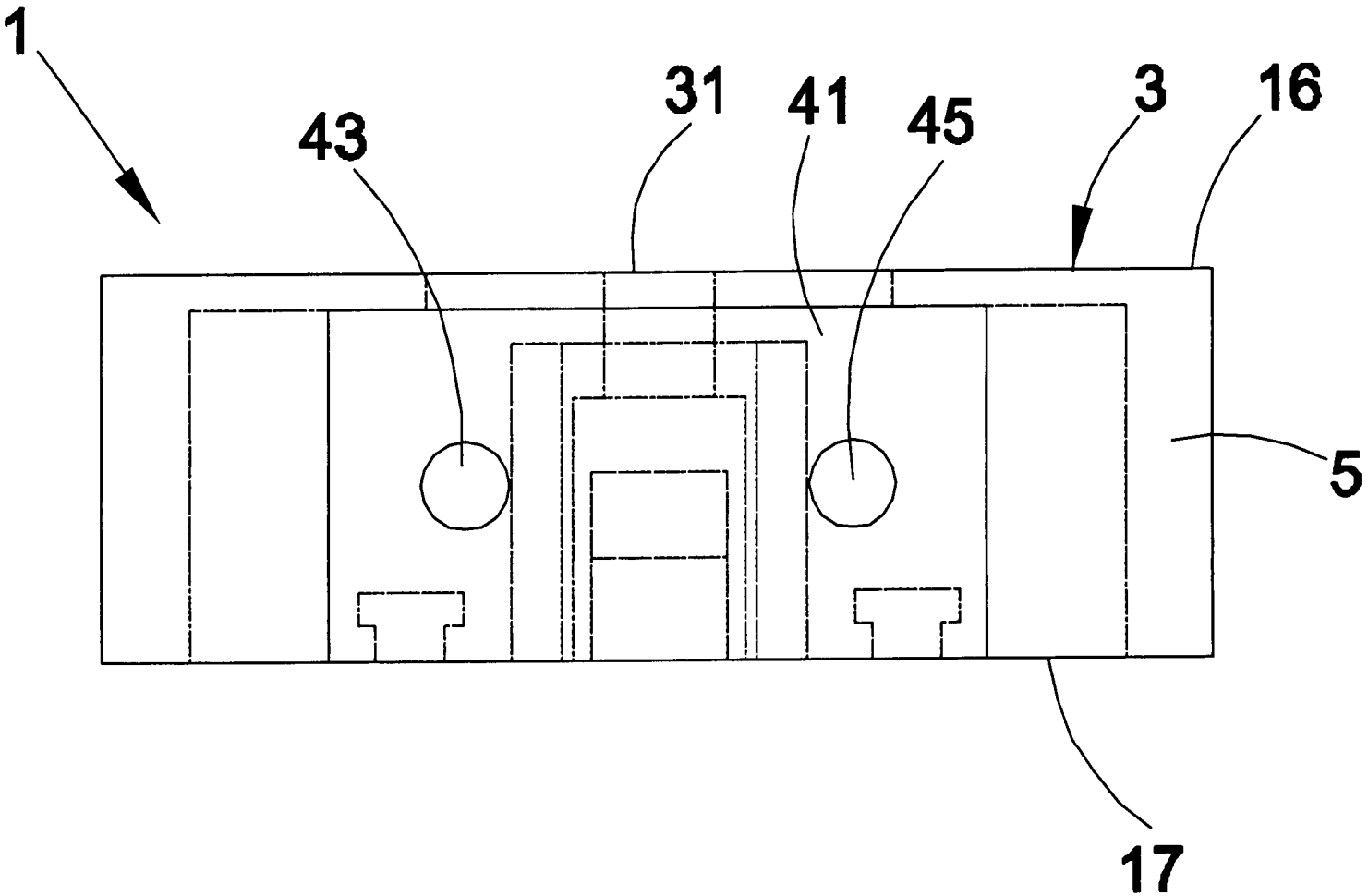
FIGS. 8, 9, 10 and 11 show front, bottom, top perspective and bottom perspective views, respectively, of the present invention clamp main housing.
Figure 9:
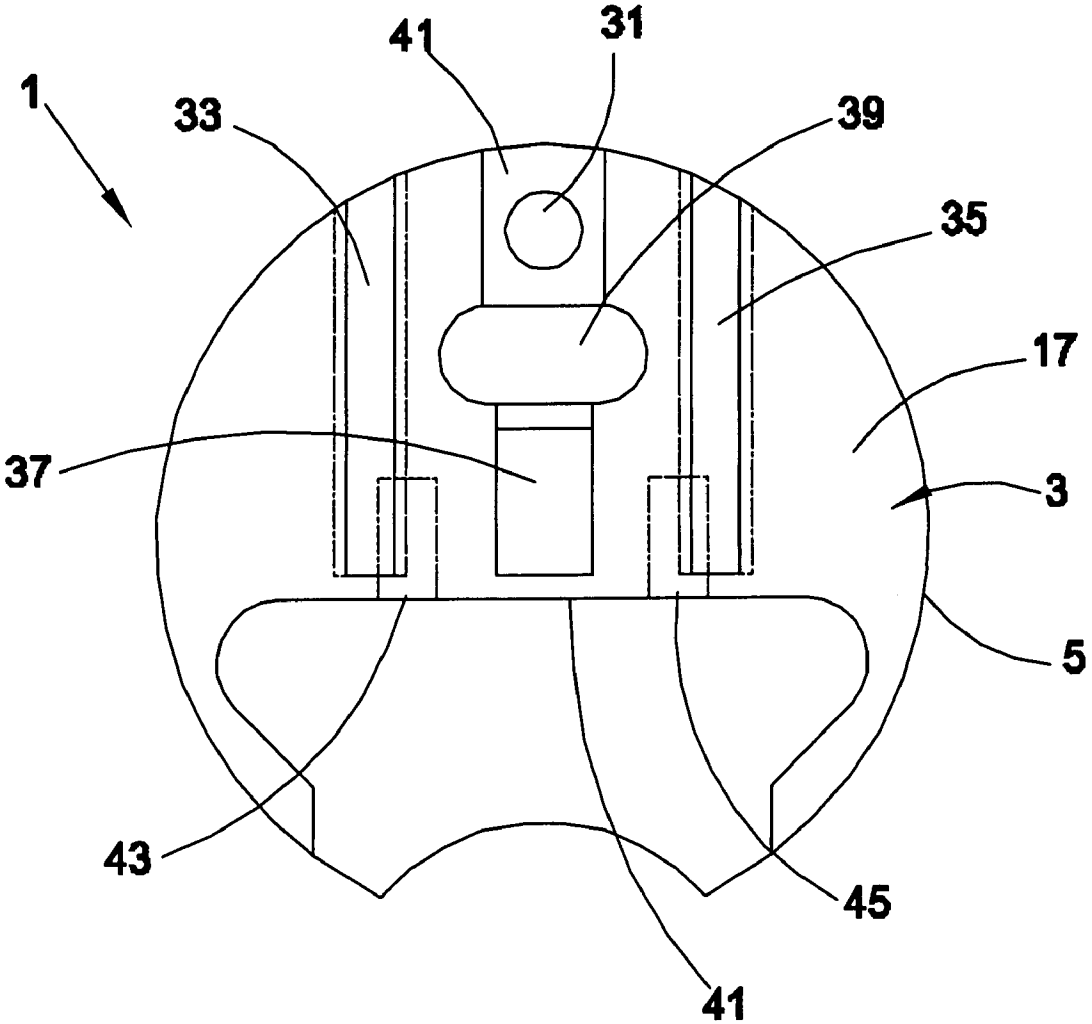
Figure 10:
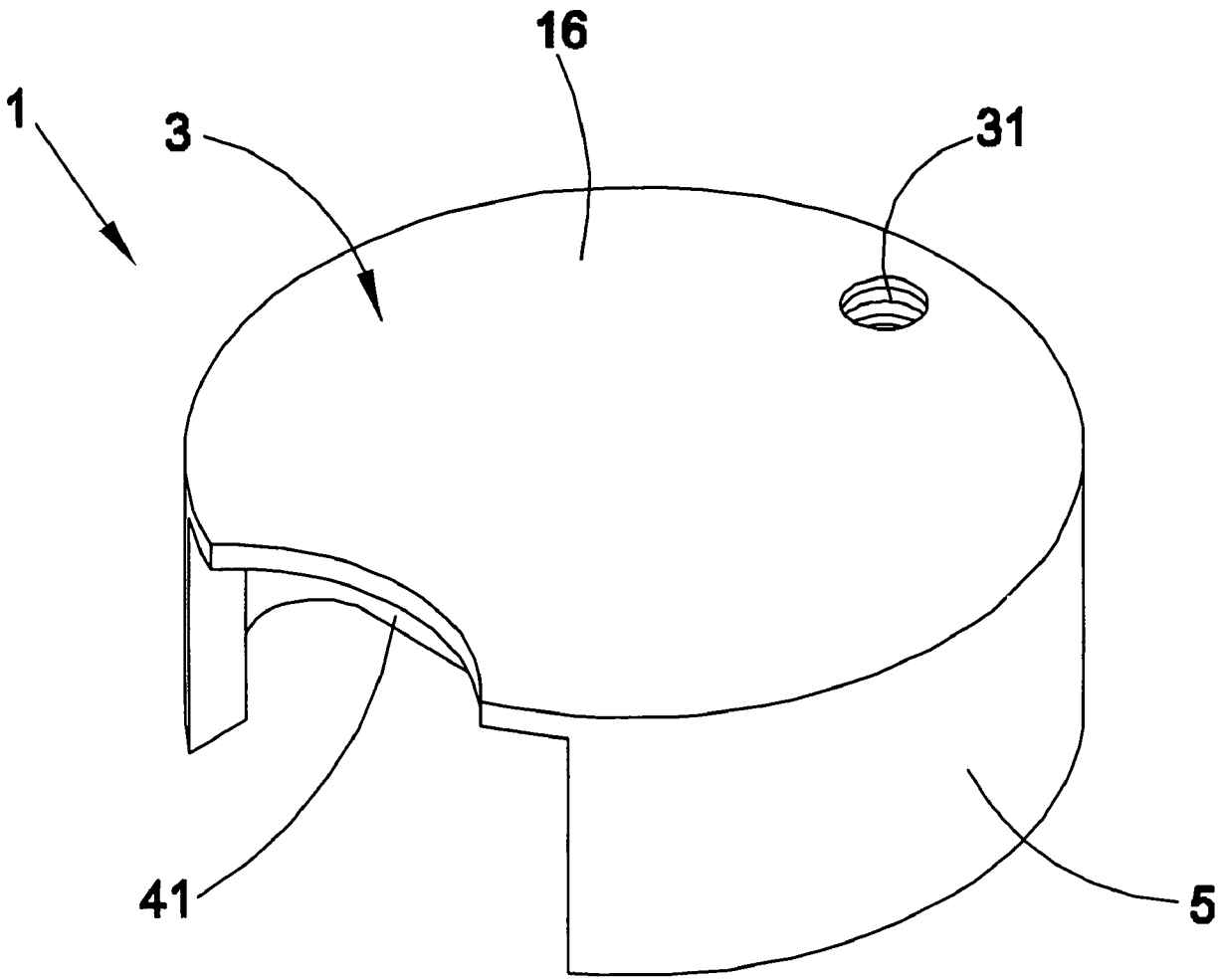
Figure 11:
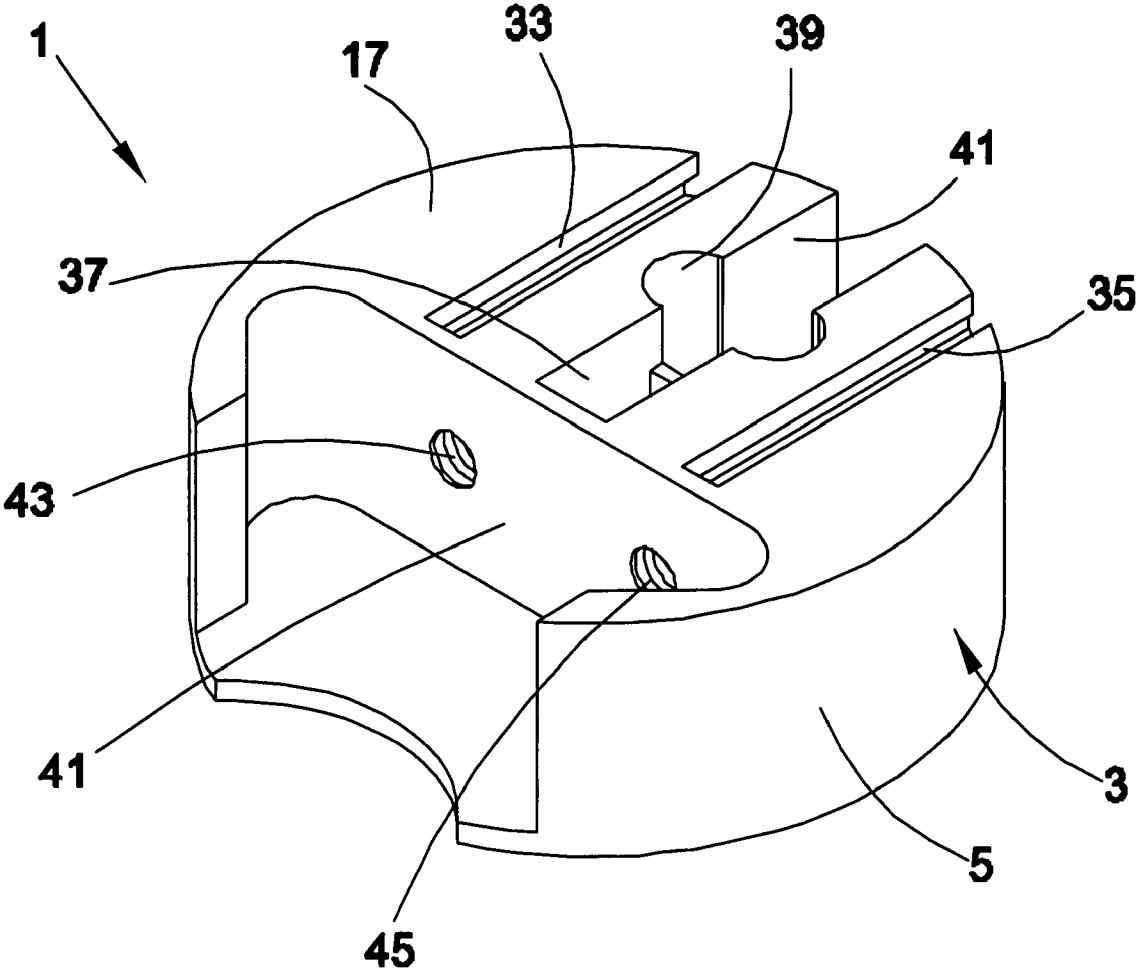
Figure 12:
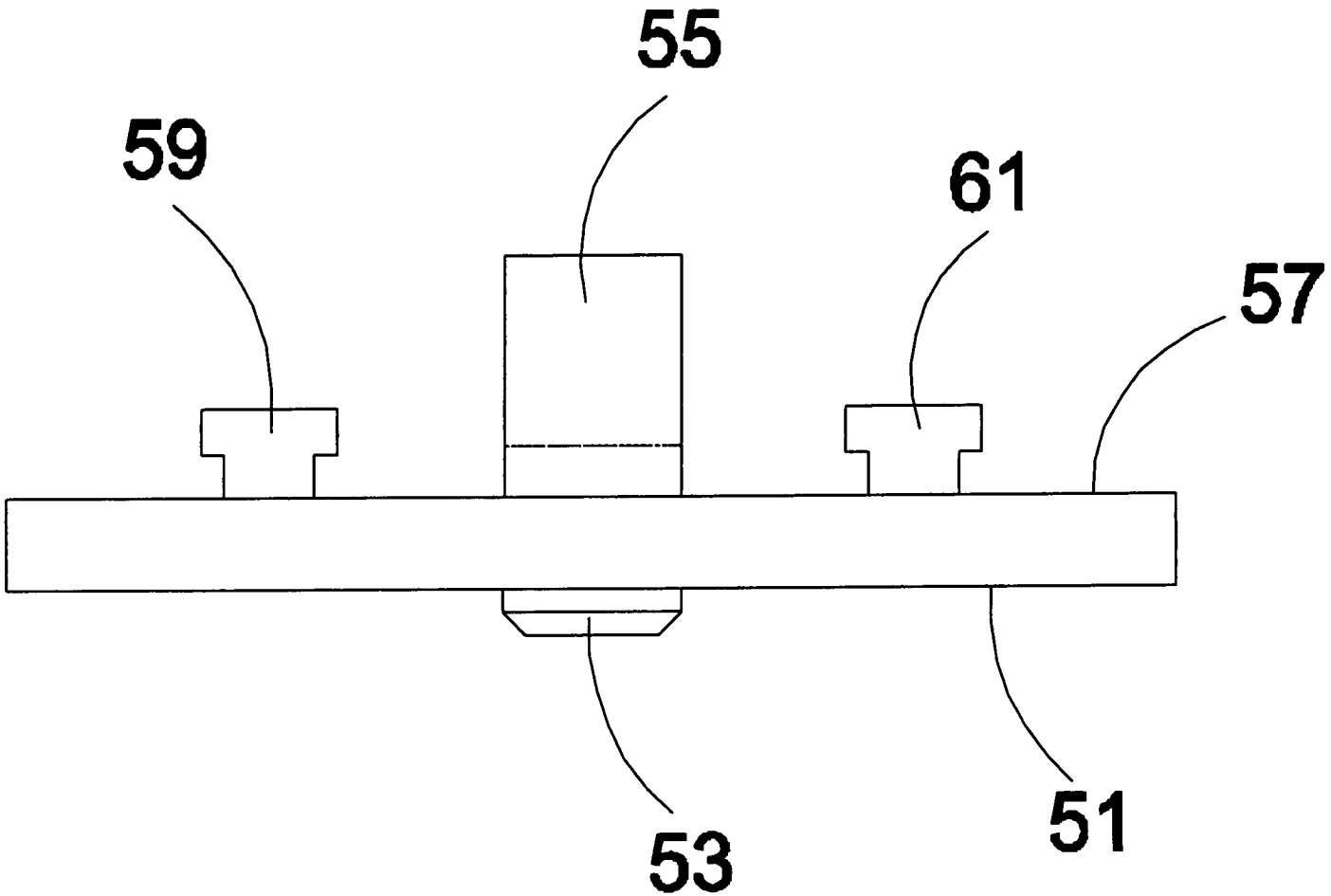
FIGS. 12, 13, 14 and 15 show front, bottom, bottom perspective and top perspective views of one preferred locking mechanism of the present invention clamp shown above.
Figure 13:
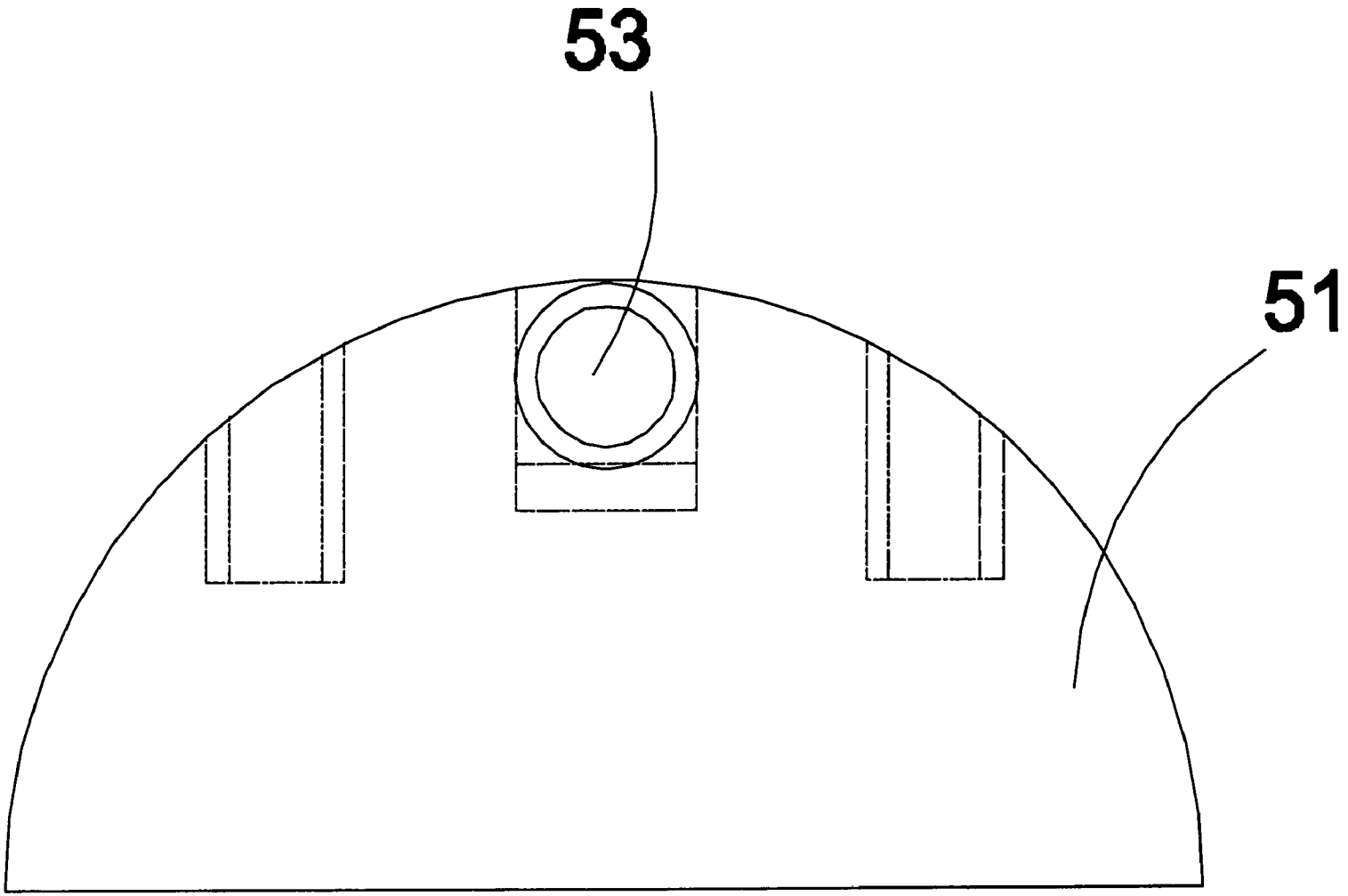
Figure 14:
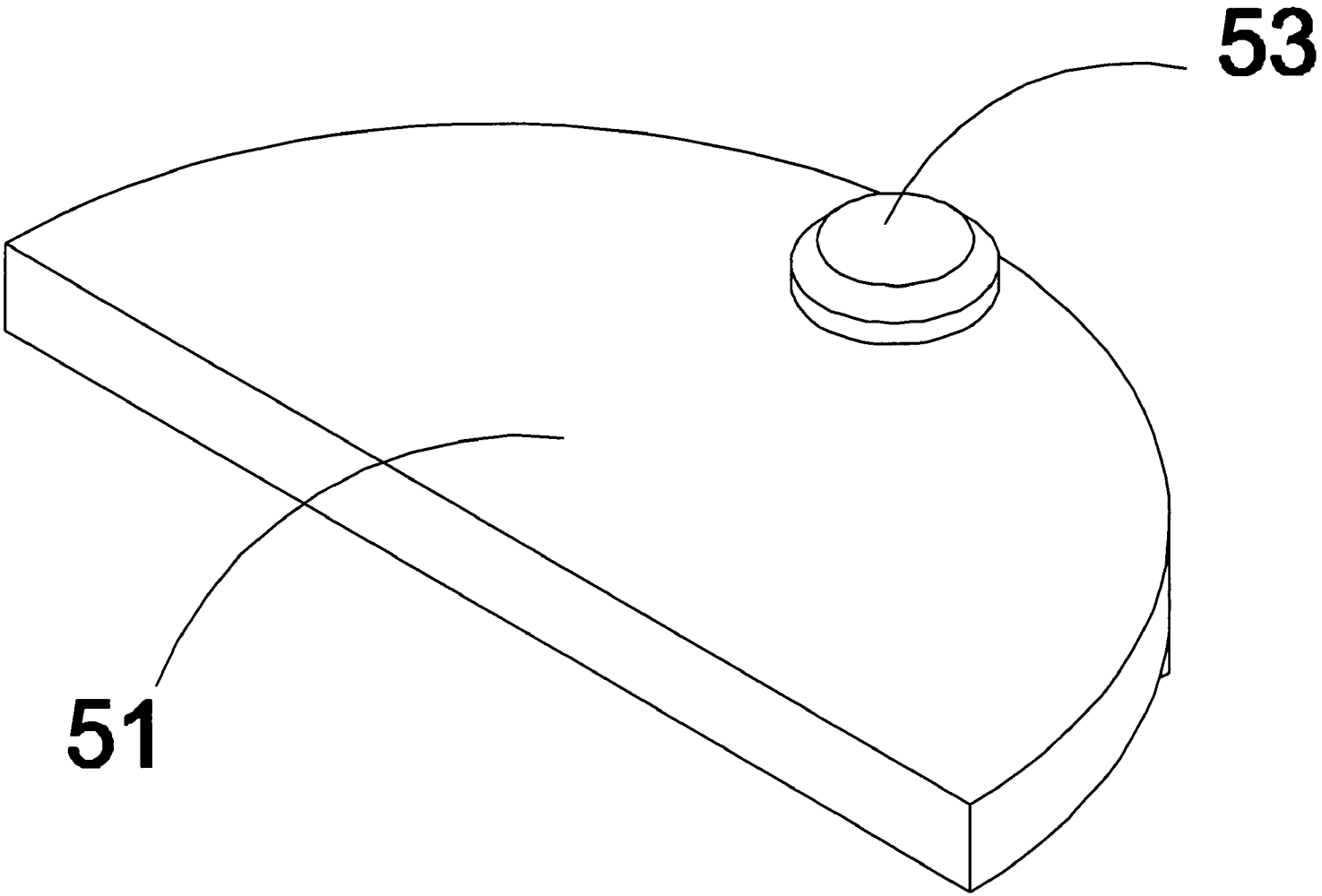
Figure 15:
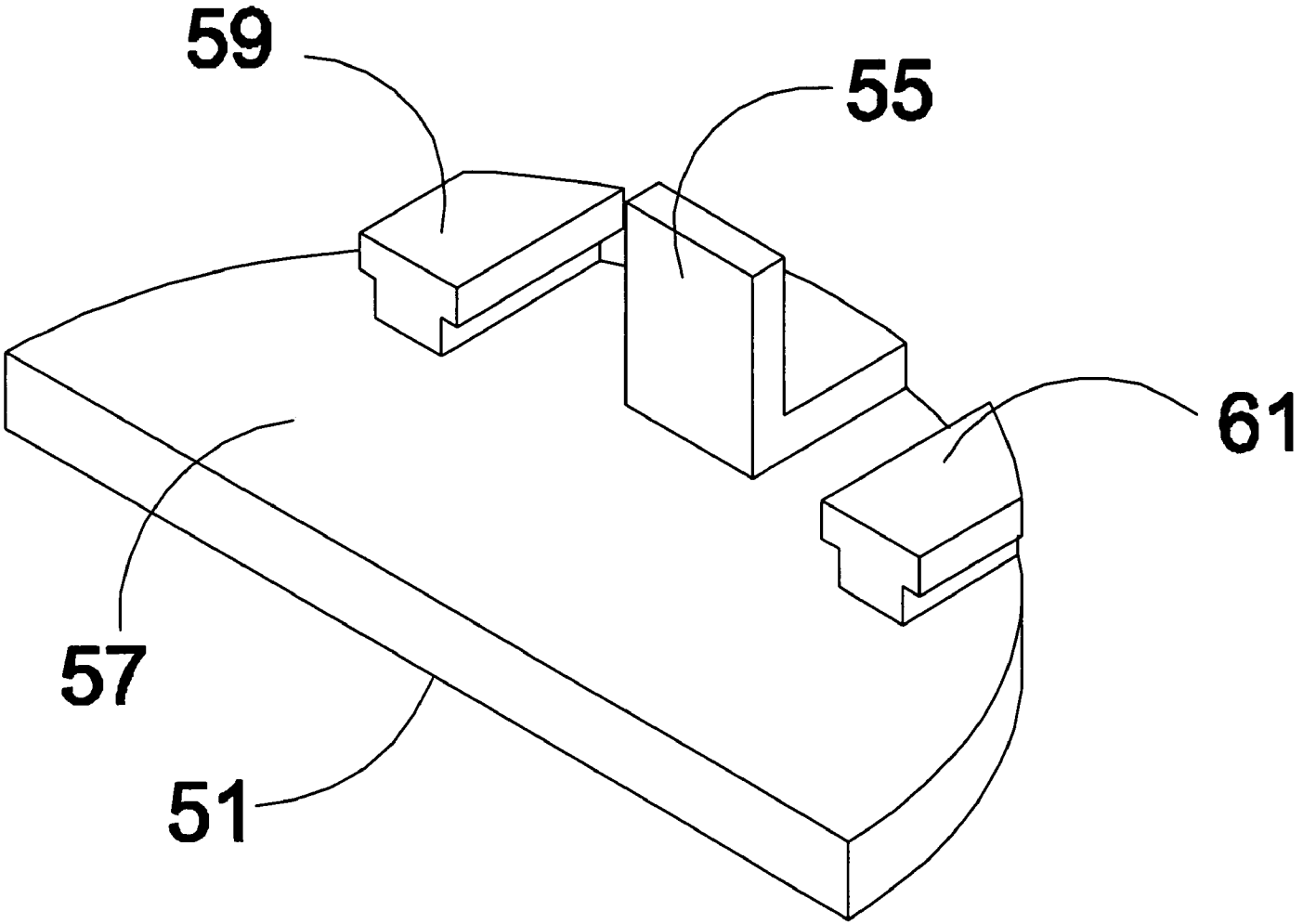

FIG. 6 shows a bottom perspective view of clamp 1 as shown in FIG. 5 but with the rod 11 inserted into female socket 39 and locking mechanism 51 open. FIG. 7 shows the same bottom perspective view as shown in FIG. 6 but with the locking mechanism 51 released to its rest-lock position wherein rod 11 is now locked into housing 3 as shown.

FIGS. 8, 9, 10 and 11 show front, bottom, top perspective and bottom perspective views, respectively, of the present invention clamp central housing 3. Taken together, these Figures show front recess 41 for receiving and holding a yoke, with yoke screw holes 43 and 45. Clamp rod locking mechanism guide tracks 33 and 35, rod cradle 41, rod end female socket 39, spring and slide plate recess 37 and rod locking screw hole 31 are located on housing bottom 17. Housing top 16 includes rod locking screw hole 31.

FIGS. 12, 13, 14 and 15 show front, bottom, bottom perspective and top perspective views of one preferred rod locking mechanism 51 of the present invention clamp 1 shown above. Clamp rod locking mechanism 51. It includes a slide button 53, a top 57 with a pair of tracking guide "T" protrusions 59 and 61, and slide plate 55 for cooperation with a spring (e.g. spring 19, FIG. 3).

Figure 16:
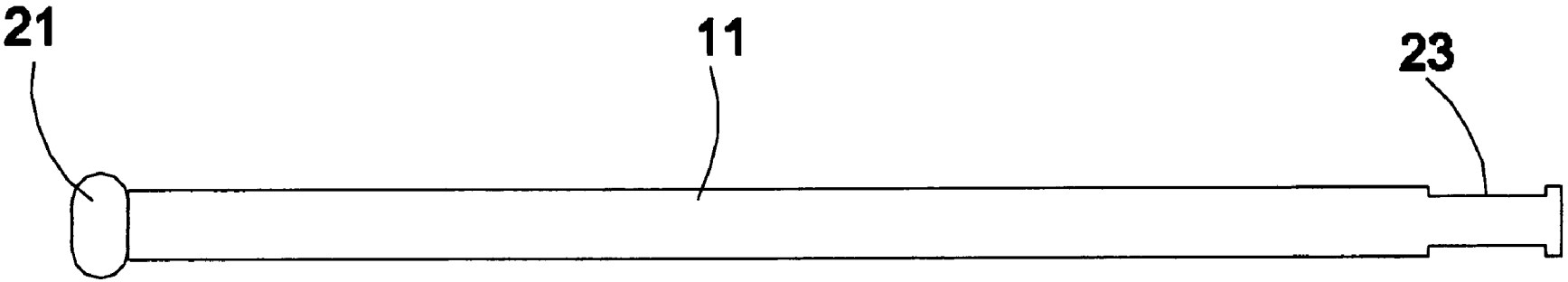
FIGS. 16 and 17 show a top view and a side perspective view, respectively, of a present invention clamp rod.
Figure 17:
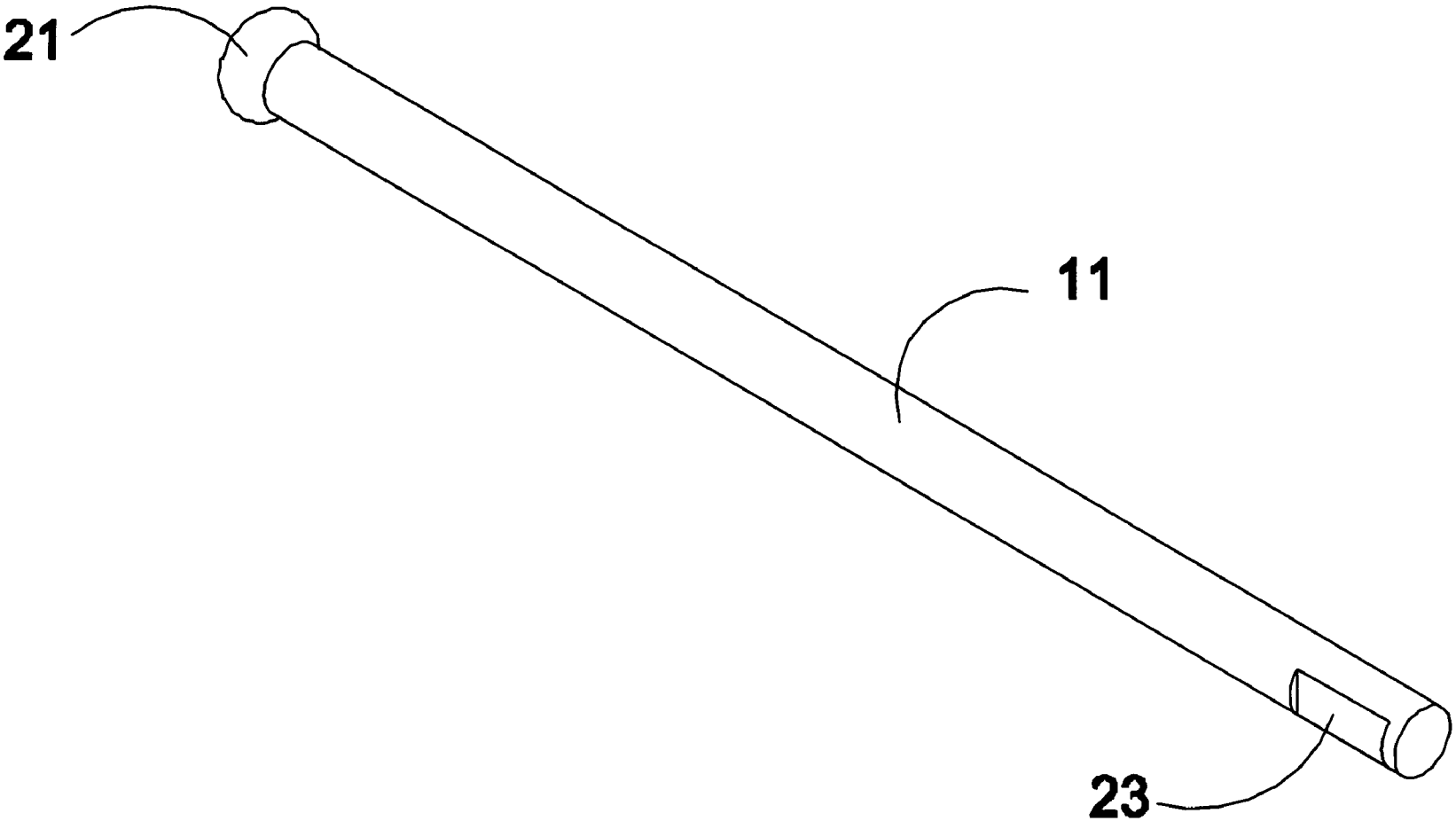

FIGS. 16 and 17 show a top view and a side perspective view, respectively, of a present invention clamp rod 11. Rod 11 has its main body that is elongated and could have any shape and one or more different cross sections. Here, for efficiency, it is cylindrical, straight and of even thickness and cross section, but the rod is not limited to this embodiment. At one end is disk end 21 for insertion into the female socket described. At the opposite end is a narrower section 23 for fitting into the rod holder described above and below.

Figure 18:
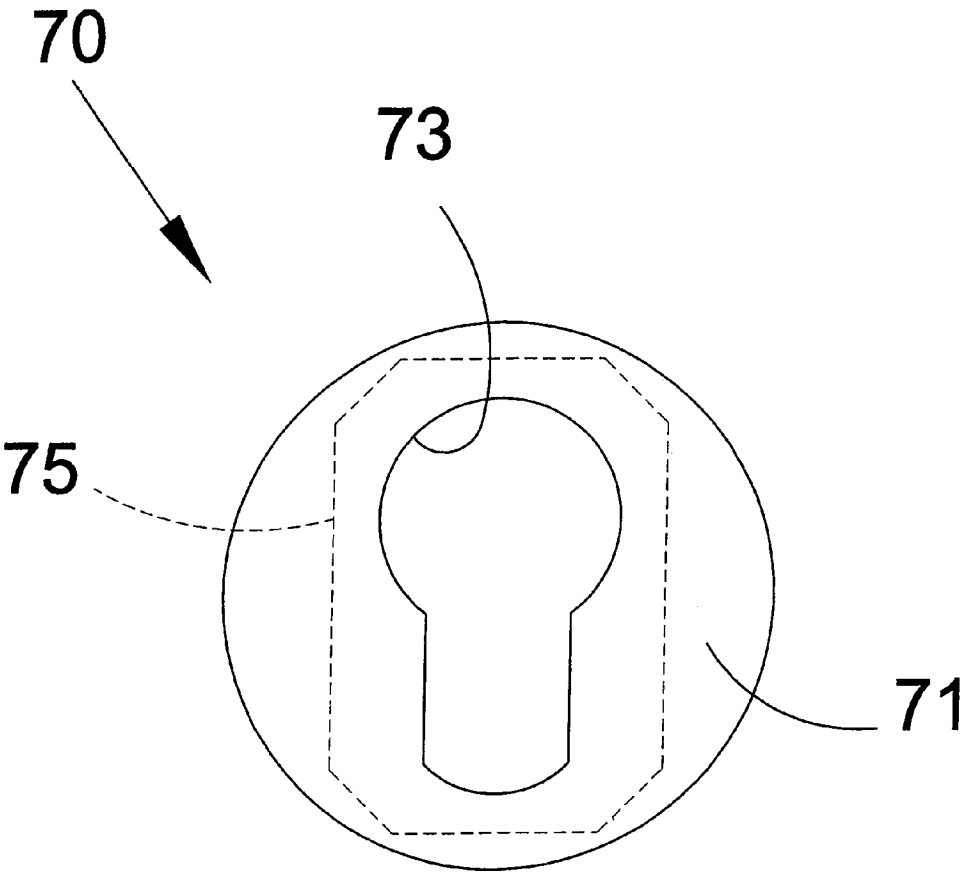
FIGS. 18 and 19 show a front view and a side perspective view, respectively, of a present invention rod holder.
Figure 19:
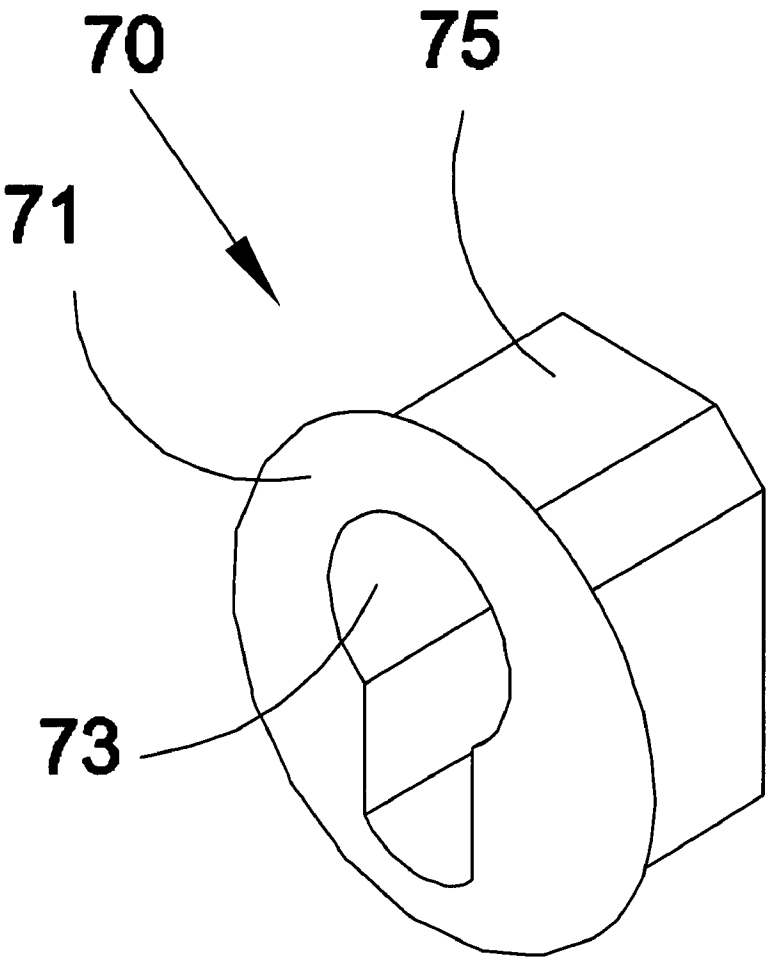

FIGS. 18 and 19 show a front view and a side perspective view, respectively, of a present invention rod holder 70. It includes a recessed housing 75, front 71, in this case circular, with a keyhole 73 with an open round top area, and open rectangular lower area and a wide back so as to receive the rod 11 shown above in a holding position (optional locking screw (s) could be included).

Figure 20:
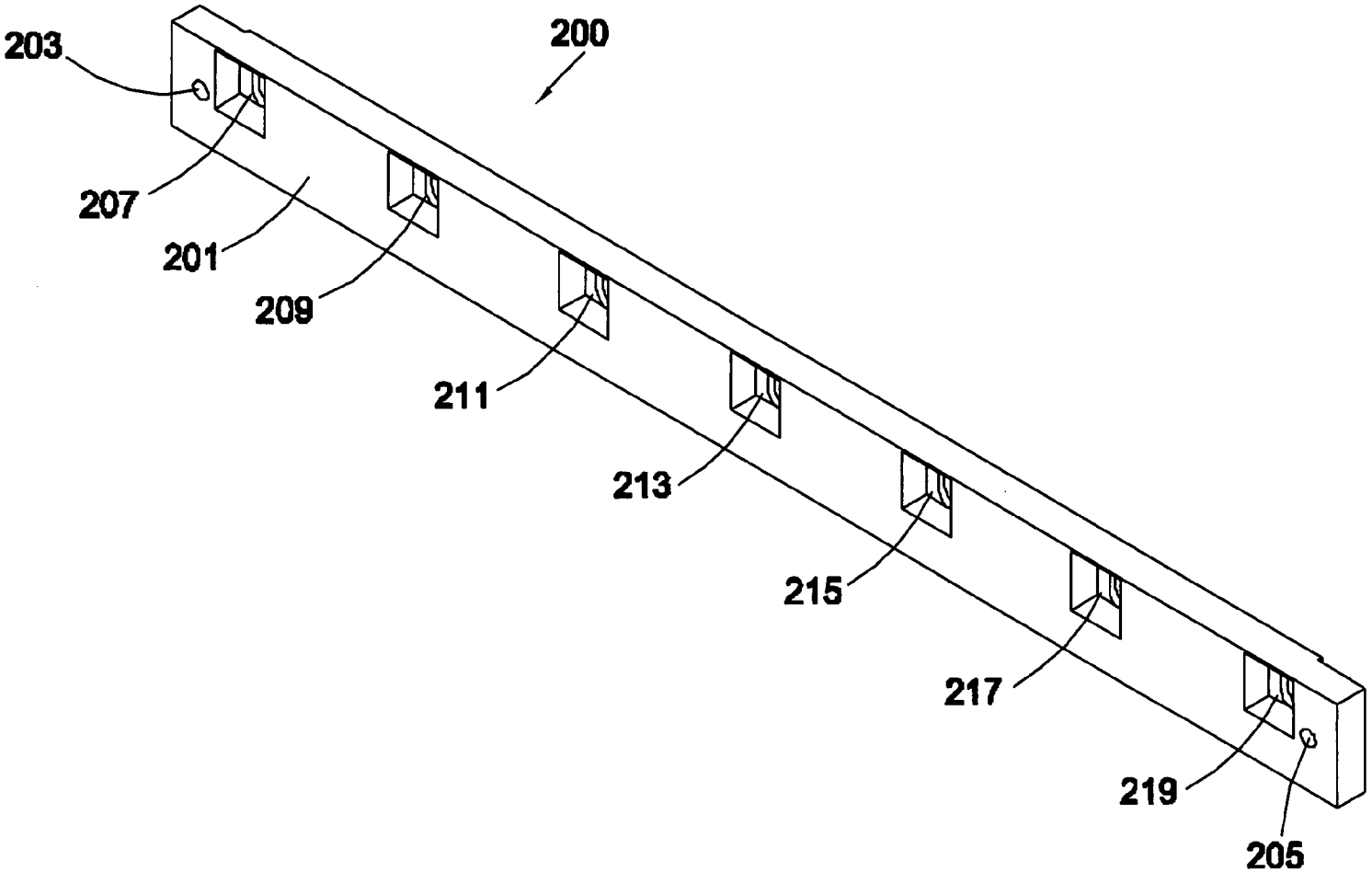
FIGS. 20, 21 and 22 show a front perspective view, a top view and a front view of a bank of rod holders to support a plurality of present invention clamps.
Figure 21:
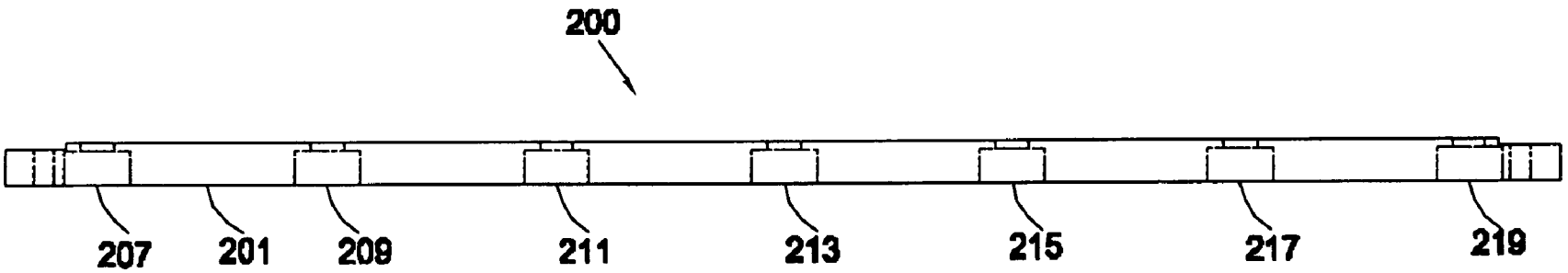
Figure 22:
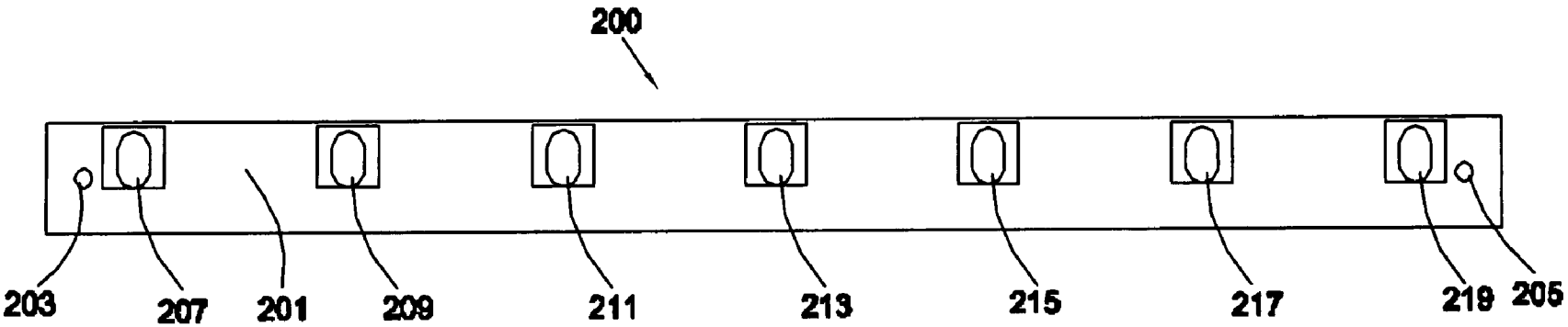

FIGS. 20, 21 and 22 show a front perspective view, a top view and a front view of a bank of rod holders 200 to support a plurality of present invention clamp rod support units, and insertable clamp rods with clamps. Bank of rod holders 200 has a front 201 with a plurality of recesses 207, 209, 211, 213, 215, 217 and 219 for receiving clamp supports of the type heretofore described. The bank or rod holders 200 may be attached to a wall, bench, or other fixture for support and back end stoppage for effective use to create a system of a plurality of present invention clamps.

Figure 23:
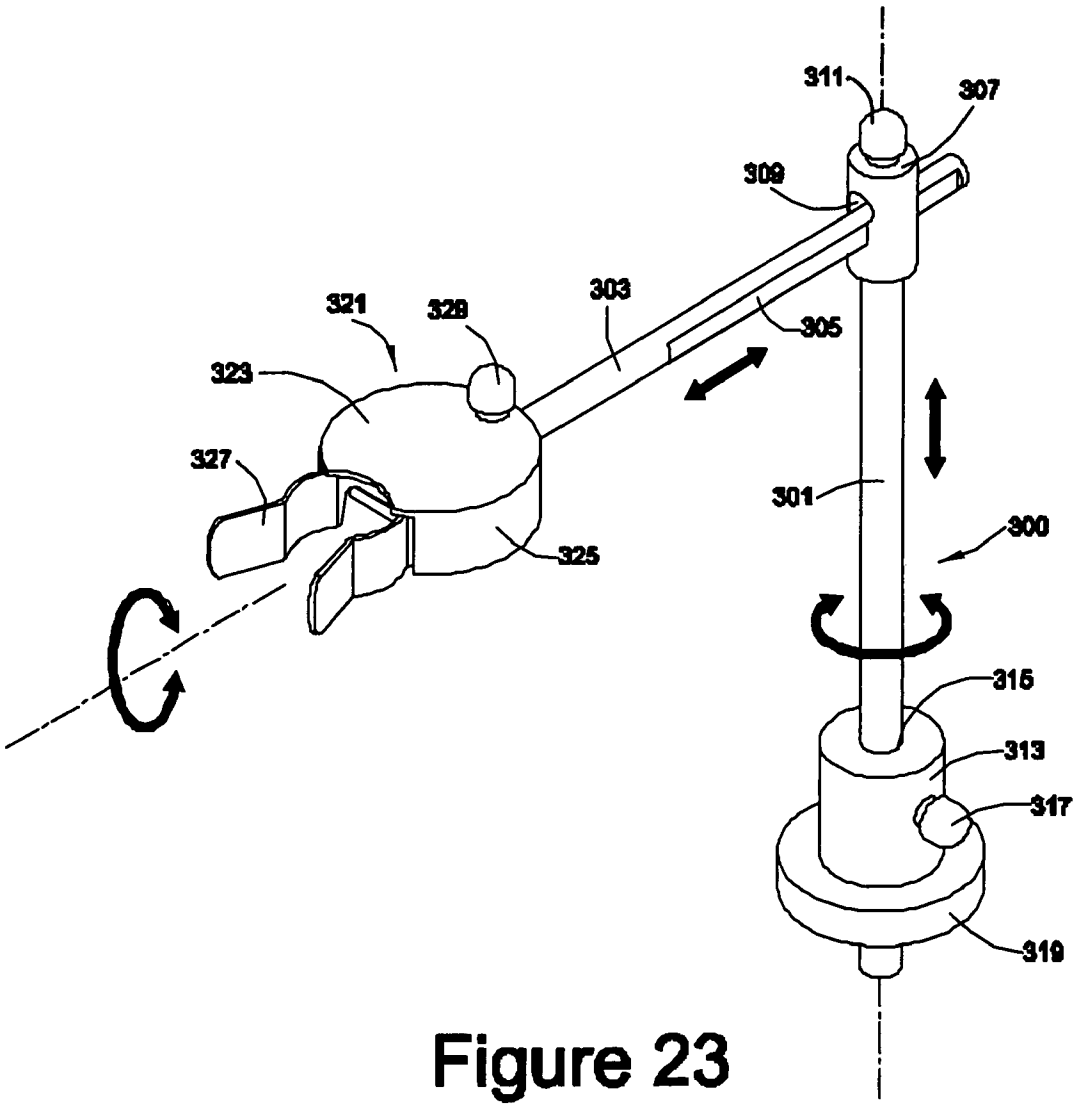
FIG. 23 shows a perspective side view of a present invention clamp system illustrating four different parameters for adjustment: vertical rotation, horizontal rotation, vertical height adjustment and horizontal depth adjustment.

FIG. 23 shows a perspective side view of a present invention clamp system 300 arrangement illustrating four different parameters for adjustment: vertical rotation, horizontal rotation, vertical height adjustment and horizontal depth adjustment. System 300 includes a clamp 321, a rod 303, a rod support unit 307, a vertical support rod 301 and a support base 319.

Clamp 321 has a central housing 323 with a circular arc sidewall 325 and a spring biased yoke 327 for attachment to a reactor. The clamp central housing 323 includes a rod rotation lock-unlock means 329 to permit and prevent rotation of clamp 321 relative to horizontal rod 303. Rod support unit 307 has a slide means for horizontal slide movement of rod 303. This slide means is a pass-through keyhole 309 to permit rod 303 (and clamp 321 attached to it at its opposite end) to move in and out of rod support unit 307. Unit 307 has a rod horizontal slide movement lock-unlock means, namely lock screw 311 to permit and prevent horizontal slide movement of rod 303 along the length of its flat 305.

Rod support unit 307 further includes a vertical support rod attachment means, (recess fittage on underside) for connection to vertical support rod 301. The attachment means on the underside is located about 90 degrees from keyhole 309.

The system 300's vertical support rod 301 is connected to rod support unit 307 at its top and to vertical support rod base 319 at its bottom. The vertical support rod 301 is rotatably connected to one of rod support unit 307 and vertical support rod base 319, preferably with lock-unlock means connected thereto to permit rotation and prevent rotation by locking and unlocking. In this case, most preferred is vertical support rod 301 being rotatably connected to vertical support rod base 319 in the vertical orifice 315 of chuck 313, with lock-unlock means 317 connected thereto to permit rotation and prevent rotation by locking and unlocking. The vertical support rod is also vertically slideably connected to vertical support rod base 319 because orifice 315 is through the chuck and base, with lock-unlock means 317 also being a slide lock-unlock means connected thereto to permit vertical sliding and prevent vertical sliding of vertical support rod 301 relative to base 319 by locking and unlocking. The system thereby provides the four degrees of freedom of movement of clamp 321 for horizontal axis rotation, horizontal axis slide, vertical axis rotation and vertical axis slide. As can now be seen, any number of degrees of freedom of movement may be created by a user to establish alternative present invention systems using various other arrangements with the foregoing components or multiples of the foregoing components.

Obviously, numerous modifications and variations of the present invention are possible in light of the above teachings. For example, although the rod support unit and vertical rod shown in FIG. 23 are described separately, in some embodiments they could be a single machined, molded or otherwise formed component. As another example, the rod support unit has a recess for the vertical support rod. However, the horizontal rod and vertical support rod could be offset and the recess replaced by an orifice, thereby permitting slide movement between the vertical support rod and the rod support unit. In such case, a connected lock-unlock means would be beneficial. It is therefore understood that within the scope of the appended claims, the invention may be practiced otherwise than as specifically described herein.

What is claimed is:

1. A chemical reactor clamp and rod for supporting a glassware reactor or equivalent chemical reactor having a neck, which comprises:

A.) a clamp having the following components:

(a) a central housing;

(b) a spring-biased yoke connected to said central housing and extending outwardly therefrom for a attachment to said reactor neck;

(c) a female socket on said central housing and adapted to receive a clamp rod; and, (d) a clamp rod locking mechanism on said central housing at said female socket wherein said clamp rod locking mechanism includes a slide button; and, B.) a rod for connection to said clamp, said rod being elongated with a central portion, a first end and an opposing second end, wherein said first end is wider than said central portion and is adapted to fit into said female socket.

2. The chemical reactor clamp and rod of claim 1 wherein said clamp rod locking mechanism includes a wide socket slot located in said female socket to receive said clamp rod with said wide end, and further includes a sliding cover to lock said clamp rod into said slot.

3. The chemical reactor clamp and rod of claim 2 wherein said rod has a central portion with a predetermined thickness and said first end has a thickness greater than said central portion predetermined thickness.

4. The chemical reactor clamp and rod of claim 3 wherein said rod is cylindrical and said central portion has a predetermined diameter and said first end has a diameter greater than said central portion diameter.

5. The chemical reactor clamp and rod of claim 1 wherein said sliding cover has an unlock position and a lock position, and said sliding cover is biased to its lock position by a biasing means connected to said cover and to said central housing.

6. A chemical reactor clamp system for supporting a glassware reactor or equivalent chemical reactor having a neck, which comprises:

A.) a clamp having the following components:

(a) a central housing;

(b) a spring-biased yoke connected to said central housing and extending outwardly therefrom for a attachment to said reactor neck;

(c) a female socket on said central housing and adapted to receive a clamp rod; and (d) a clamp rod locking mechanism on said central housing at said female socket wherein said clamp rod locking mechanism includes a slide button;

B.) a rod for connection to said clamp, said rod being elongated with a central portion, a first end and an opposing second end, wherein said first end is wider than said central portion and is adapted to fit into said female socket, and wherein said second end has a key shape adapted to fit into a keyhole;

C.) a rod support unit, including a support housing and a rod keyhole adapted to receive said second end of said rod.

7. The chemical reactor clamp system of claim 6 wherein said clamp rod locking mechanism includes a wide socket slot located in said female socket to receive said clamp rod with said wide end, and further includes a sliding cover to lock said clamp rod into said slot.

8. The chemical reactor clamp system of claim 7 wherein said rod has a central portion with a predetermined thickness and said first end has a thickness greater than said central portion predetermined thickness.

9. The chemical reactor clamp system of claim 8 wherein said rod is cylindrical and said central portion has a predetermined diameter and said first end has a diameter greater than said central portion diameter.

10. The chemical reactor clamp system of claim 9 wherein said sliding cover has an unlock position and a lock position, and said sliding cover is biased to its lock position by a biasing means connected to said cover and to said central housing.

11. The chemical reactor clamp system of claim 6 wherein said spring biased yoke is a resilient metal strip having an open end and opposing arc sections for clamping to opposing sections of a chemical reactor neck.

12. A chemical reactor clamp for supporting a glassware or equivalent chemical reactor having a neck, which comprises:

(a.) a central housing;

(b.) a spring-biased yoke connected to said central housing and extending outwardly therefrom for attachment to said reactor neck;

(c.) a female socket on said central housing and adapted to receive a clamp rod; and, (d.) a clamp rod locking mechanism on said central housing at said female socket wherein said clamp rod locking mechanism includes a slide button, and wherein said clamp rod locking mechanism includes a wide socket slot located in said female socket to receive said clamp rod with a wide end, and further includes a sliding cover to lock said clamp rod into said slot.

13. The chemical reactor clamp of claim 12 wherein said sliding cover has an unlock position and a lock position, and said sliding cover is biased to its lock position by a biasing means connected to said cover and to said central housing.

14. The chemical reactor clamp of claim 12 wherein said spring-biased yoke is a resilient metal strip having an open end and opposing arc sections for clamping to opposing sections of a chemical reactor neck.

* * * * *